US006220529B1

(12) United States Patent
Xu

(10) Patent No.: US 6,220,529 B1
(45) Date of Patent: Apr. 24, 2001

(54) DUAL PRESSURE VALVE ARRANGEMENT FOR WATERJET CUTTING SYSTEM

(75) Inventor: Jian Xu, Plymouth, MN (US)

(73) Assignee: Jet Edge Division TC/American Monorail, Inc., St. Michael, MN (US)

( * ) Notice: Subject to any disclaimer, the term of this patent is extended or adjusted under 35 U.S.C. 154(b) by 0 days.

(21) Appl. No.: 09/501,637

(22) Filed: Feb. 10, 2000

(51) Int. Cl.[7] ..... B05B 7/30; B05B 1/30

(52) U.S. Cl. ..... 239/569; 239/101; 239/DIG. 8; 239/340; 137/872; 83/177

(58) Field of Search ..... 239/340, 101, 239/569, DIG. 8; 137/872, 885; 83/53, 177

(56) References Cited

U.S. PATENT DOCUMENTS

| | | | | |
|---|---|---|---|---|
| 3,207,443 | | 9/1965 | Gilmour . | |
| 3,445,069 | | 5/1969 | Druge . | |
| 3,774,847 | | 11/1973 | Malec . | |
| 4,594,924 | | 6/1986 | Windisch . | |
| 4,693,153 | | 9/1987 | Wainwright et al. . | |
| 4,934,111 | | 6/1990 | Hashish et al. . | |
| 5,018,670 | | 5/1991 | Chalmers . | |
| 5,020,726 | | 6/1991 | Myres . | |
| 5,070,907 | | 12/1991 | Salecker . | |
| 5,339,715 | * | 8/1994 | Coleman | 83/53 |
| 5,851,139 | | 12/1998 | Xu . | |
| 6,126,524 | * | 10/2000 | Sheperd | 83/177 X |

* cited by examiner

*Primary Examiner*—David A. Scherbel
*Assistant Examiner*—Robin O. Evans
(74) *Attorney, Agent, or Firm*—Haugen Law Firm PLLP

(57) ABSTRACT

An ultra high pressure waterjet cutting system which includes a valve for selectively delivering either a stream of ultra-high pressure water or alternatively, a moderately reduced but yet sufficiently high pressure to initiate cutting. The arrangement provides a convenient means for initiating cuts along the edges of workpieces and is particularly useful when encountering surfaces of brittle workpieces.

1 Claim, 4 Drawing Sheets

10
11
12
13
14
15
17
18
19
20
21
22
24
25
26
28
29
30
32
COMPRESSED AIR SOURCE
ABRASIVE DELIVERY CONTROL
PRESSURE SELECTOR CONTROL
ABRASIVE DELIVERY
PUMP/ INTENSIFIER
ULTRA-HIGH PRESSURE WATER SUPPLY
REDUCED PRESSURE WATER
ABRASIVE/WATER WORKING STREAM

DUAL PRESSURE VALVE ARRANGEMENT FOR WATERJET CUTTING SYSTEM

BACKGROUND OF THE INVENTION

The present invention relates generally to an improved system for delivery of ultra-high pressure water from a pump/intensifier to the nozzle of a waterjet cutting system, and more particularly to such a system which provides for a continuous flow from the pump/intensifier through the entire system and with nozzle discharge being at a pre-selected working pressure of either an ultra-high or a high pressure range. The arrangement of the present invention facilitates utilization of waterjet cutting systems for piercing operations on brittle or hard materials, as well as utilization of these systems on such materials without requiring cut-initiation from an outside edge of the workpiece. The features of the present invention will be discussed in detail hereinbelow.

Waterjet cutting systems are typically used for forming or cutting irregular or unusual patterns in dense and/or hard materials. Frequently, entrained abrasive is added to the discharge so as to provide a greater cutting force with the focused discharge stream of ultra-high pressure water from the nozzle. These systems are adapted for use in cutting or shaping brittle materials including metals, plastics and glass, including hardened glass as well as stone objects consisting of marble, granite or the like. Fragile materials are also uniquely suited for some types of ultra-high pressure waterjet cutting systems.

By definition, ultra-high pressure water systems typically utilize an operating pressure of at least 55,000 psi. In certain applications, pressures as high as 75,000 psi have been found useful as well.

In the operation of waterjet cutting systems, all components are subject to mechanical wear and require periodic maintenance and service. In a typical operational system, one component requiring an unusual amount of attention is the pump/intensifier. Maintenance problems are occasioned in significant part by the number of start-up cycles to which the pump/intensifier is subjected, rather than simply the time duration of operation. When subjected to less frequent start-ups, the overall life of a pump/intensifier between overhauls can be extended. The present invention facilitates operational cycles of longer duration, with the pump operating continuously under substantially the same high pressure conditions during the duration of these operational cycles.

In accordance with current practice, whenever it is desirable to change operational parameters such as cut location, or simply the introduction of fresh workpieces to the system, the operator typically de-energizes the pump/intensifier. By contrast, and in accordance with the present invention, the operator actuates a selector valve which is interposed between the pump/intensifier and the cutting nozzle, with this being a "T" valve and creating a normally open, continuously running lower working pressure bypass flow between the pump/intensifier and the cutting head. The bypass includes a pressure reducer in which the pressure of water passing through the bypass is dropped from the ultra-high level to a substantially lower but nevertheless working pressure level. Stated another way, in the line coupling the pump/intensifier to the cutting head a pressure reducer/bypass is interposed which is maintained in a normally open position during all periods of operation of the pump/intensifier.

The dual pressure selector valve arrangement enables constant operation of the pump/intensifier. Accordingly, the present invention employs a nozzle assembly and selector valve so as to deliver a constant stream of water entrained abrasive (if desired) to the surface of a workpiece at either of two significantly different working pressures. The system includes a cutting head capable of delivering water at a first ultra-high pressure in excess of about 55,000 psi, and also at a second somewhat reduced working pressures such as in the area of between about 5,000 and 55,000 psi. This arrangement makes it possible for the pump/intensifier to maintain continuous operation at the ultra-high pressure level for heavy duty cutting operations, without necessarily having to occasionally vary its operational parameters between ultra-high working pressure and a somewhat reduced but effective working pressure.

The ultra-high working pressure is utilized for conventional cutting applications, with the lower working pressure being utilized for initiating cuts or for piercing workpieces. This pressure reduction feature is particularly helpful when the workpiece consists of a brittle material such as glass, acrylics, some laminates, brittle metals and the like. The higher pressure working streams are prone to fracture the edges and/or the surfaces of the workpiece. In other words, the workpiece is better able to withstand forces from ultra-high working pressures as the cutting zone is ultimately moved inwardly from the peripheral edge, or when a piercing operation is completed. Since, the workpieces are better able to withstand forces from ultra-high working pressures and forces created from exposure to ultra-high working pressures once the workpiece has been completely pierced.

In accordance with the present invention, a selector valve arrangement is provided having an internal "T" arrangement in the head assembly. High pressure water enters the valve and passes into a three-way chamber with flow being controlled by a needle valve. In its closed position, the needle valve causes the water to pass through the channel leading to a series of cylindrical members with eccentric bores formed therein to create a drop in pressure, while at the same time permitting a modest flow rate to continue. This flow rate and operating pressure represent the lower of the two working pressures being delivered through the system. When ultra-high pressure is needed the needle valve is opened, whereupon flow of ultra-high pressure water passes through the main passageway and directly to the cutting head. The lower pressure line remains open during the entire operation, and in effect creates a parallel flow pattern without disruption of the coherent nature of the high pressure flow.

Therefore, it is the primary object of the present invention to provide an improved waterjet cutting system which employs a nozzle assembly provided with a means for delivering a stream of water or water with entrained abrasive onto a workpiece at two significantly different working pressures, with the pump/intensifier operation being uninterrupted.

It is a further object of the present invention to provide an improved waterjet cutting system which permits continuous operation of a pump/intensifier while delivering water entrained abrasive to a workpiece at either one of two selected working pressures, with one of the working pressures being an ultra-high pressure, and with the other being at a reduced but yet effective working or cutting pressure.

It is yet a further object of the present invention to provide a waterjet cutting system which permits the pump/intensifier to maintain operation continuously while cutting operations are undertaken at either of two selected working pressures.

It is still a further object of the present invention to provide an improved waterjet cutting system designed to initiate cuts and/or piercing of workpieces through the utilization of a pressure reduction feature which permits the discharge of water entrained abrasive at working pressures significantly less than ultra-high working pressures employed for normal cutting.

Other and further objects of the present invention will become apparent to those skilled in the art upon a study of the following specification, appended claims and accompanying drawings.

IN THE DRAWINGS

FIG. 1 is a schematic diagram of a waterjet cutting system arranged in accordance with the present invention;

FIG. 2 is a detail elevational view of the selector valve as employed in the present invention;

FIG. 3 is a sectional view taken through the diameter of the selector valve as illustrated in FIG. 2, and illustrating the detail of the pressure reducer; and FIG. 4 is a detail sectional view of a fragmentary portion of the selector valve, with the portions being cut away, and illustrating the arrangement of the internal arrangement of the selector valve and pressure reducer components.

DESCRIPTION OF THE DRAWINGS

In accordance with the preferred embodiment of the present invention, and with particular attention being directed to FIG. 1 of the drawings, the waterjet cutting system generally designated 10 includes an abrasive hopper 11 with a discharge conduit as at 12 delivering abrasive into a metering arrangement as in 13. Abrasive is delivered to conduit 14 directly to the cutting head 15. Ultra-high pressure water is supplied through pump/intensifier 17, and delivered along delivery conduit 18 to pressure control or selector valve 19. Selector valve 19 is controlled by pressure selector control 20. Abrasive may alternatively be delivered in accordance with the system disclosed in copending application Ser. No. 09/237,582, filed Jan. 26, 1999, entitled "ABRASIVE DELIVERY SYSTEM", and assigned to the same assignee as the present invention. Ultra-high pressure water enters selector valve 19 through inlet 21, with valve 19 providing a constant flow of water to the outlet at a reduced pressure to a bypass arm through outlet 22 and on to cutting head 15. When selector valve 19 is open, ultra-high pressure water flows from outlet 24 to conduit 25 to inlet 26 of cutting head 15. The details of cutting nozzles are known such with one typical cutting nozzle being disclosed in U.S. Pat. 5,018,670 dated May 28, 1991 and entitled "CUTTING HEAD FOR WATERJET CUTTING MACHINE"; and U.S. Pat. No. 5,851,139 dated Dec. 22, 1998, titled "CUTTING HEAD FOR A WATERJET CUTTING ASSEMBLY" and assigned to the same assignee of the present invention.

For overall control of the system, a compressed air source provided as at 28, and delivers flow of air to abrasive control 29 as well as to control valve 20 functioning with selector valve 19.

Figure 1:
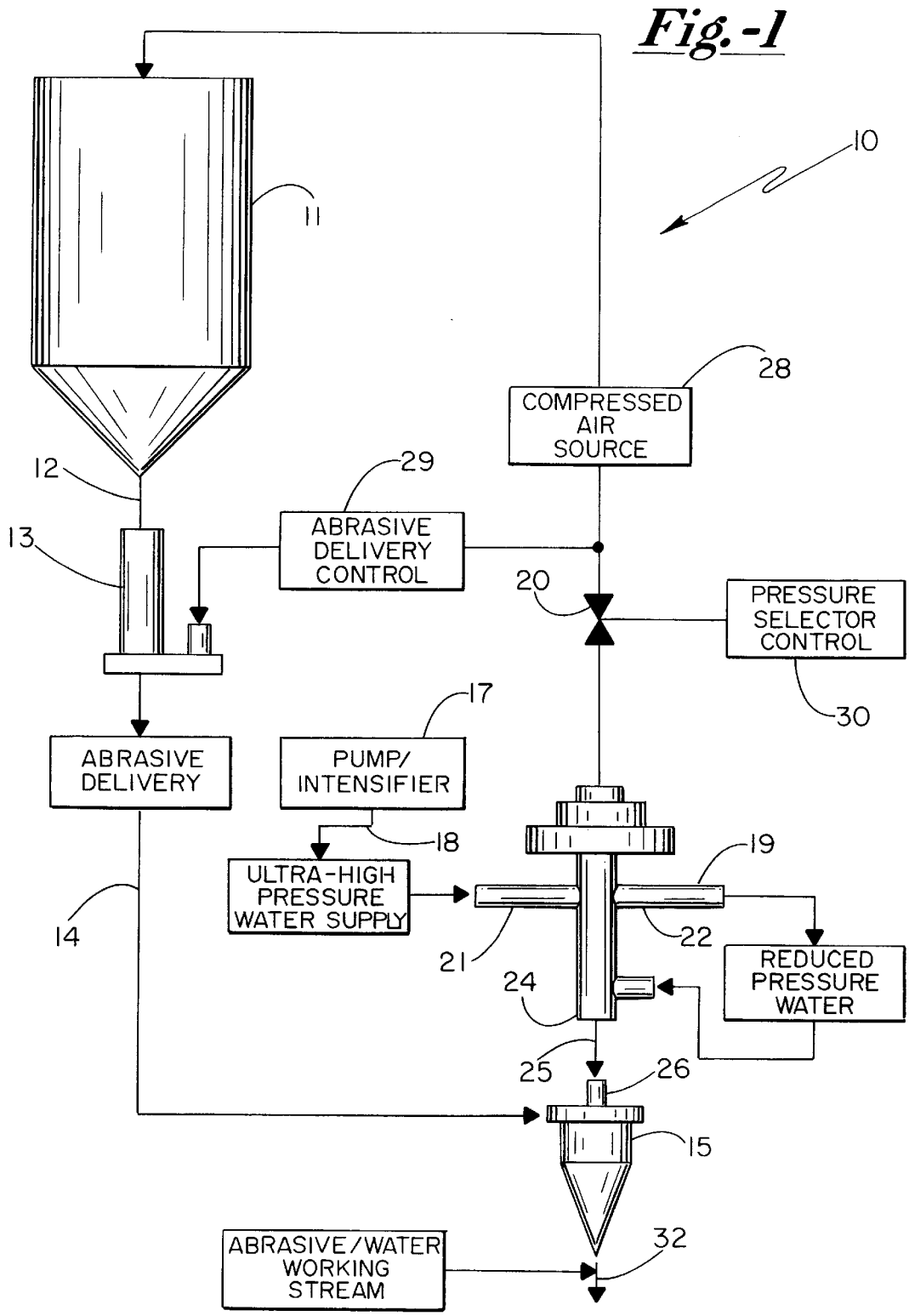

In the arrangement illustrated in FIG. 1, a working stream of water is delivered to head 15 through the normally open channel to outlet 22 of selector valve 19. This flow makes up the reduced pressure working stream and due to the normally open disposition of outlet 22, this flow occur is ongoing at all times. At the same time, selector control 30 is provided to controllably open or close a needle valve disposed within selector valve 19 so as to either permit or prevent a flow of ultra-high pressure water from the pump/intensifier 17 through valve 19 and thence through line 25 to cutter head 15. Also, abrasive delivery control 29 permits a flow of metered abrasive along conduit 14 to cutter head 15 so as to enhance the cutting capability of the abrasive/water working stream delivered from nozzle 15 as at 32.

Figure 2:
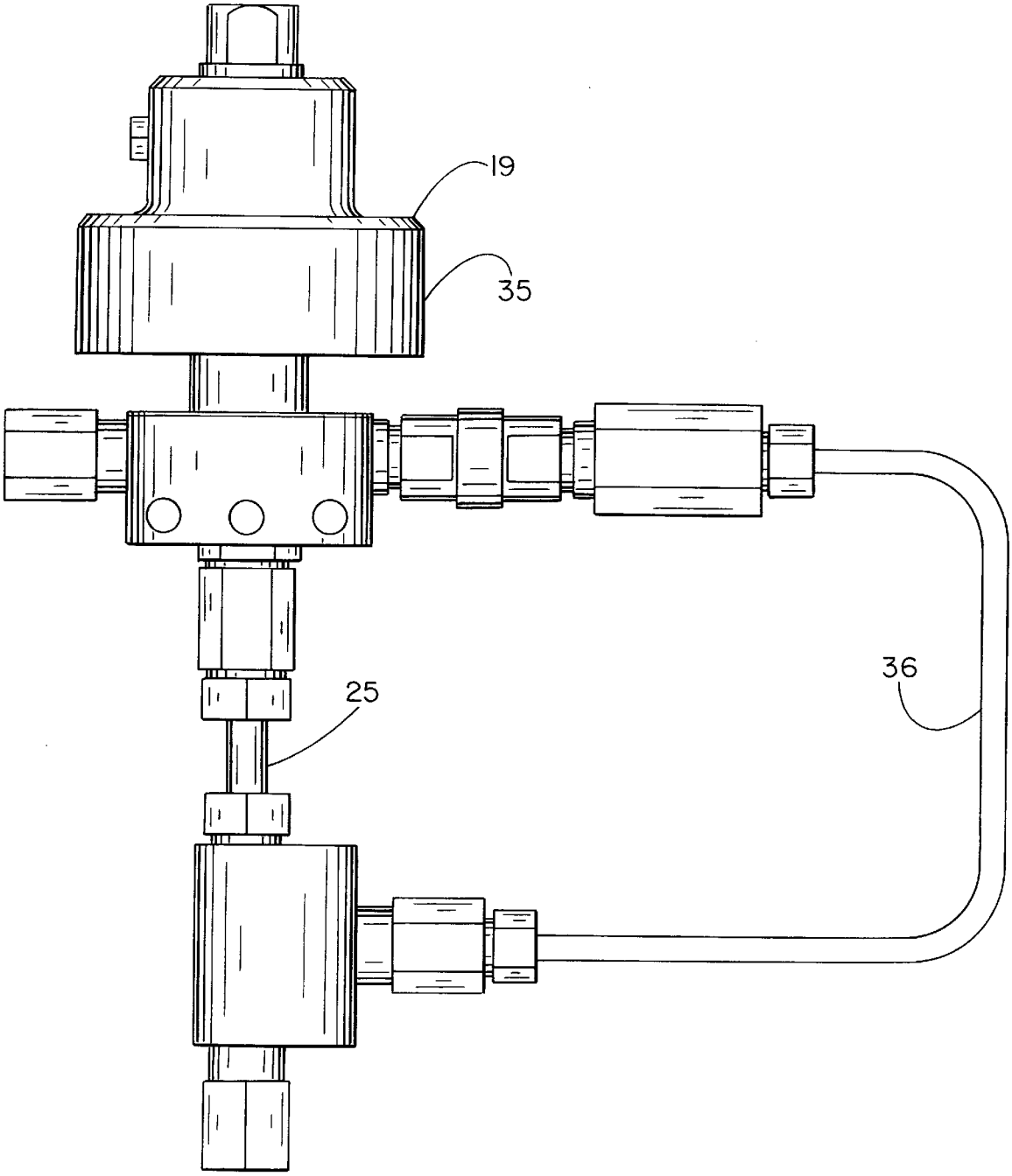

With attention now being directed to FIG. 2 of the drawings, control valve 19 comprises a valve body as at 35, with this being a three-way valve having one normally open channel through the bypass link 36 through which a working stream of water at slightly reduced but yet effective working pressure is permitted to flow. Conduit 25 delivers ultra-high pressure water from valve 19 to cutter head 15, as previously indicated and discussed in connection with FIG. 1.

Figure 3:
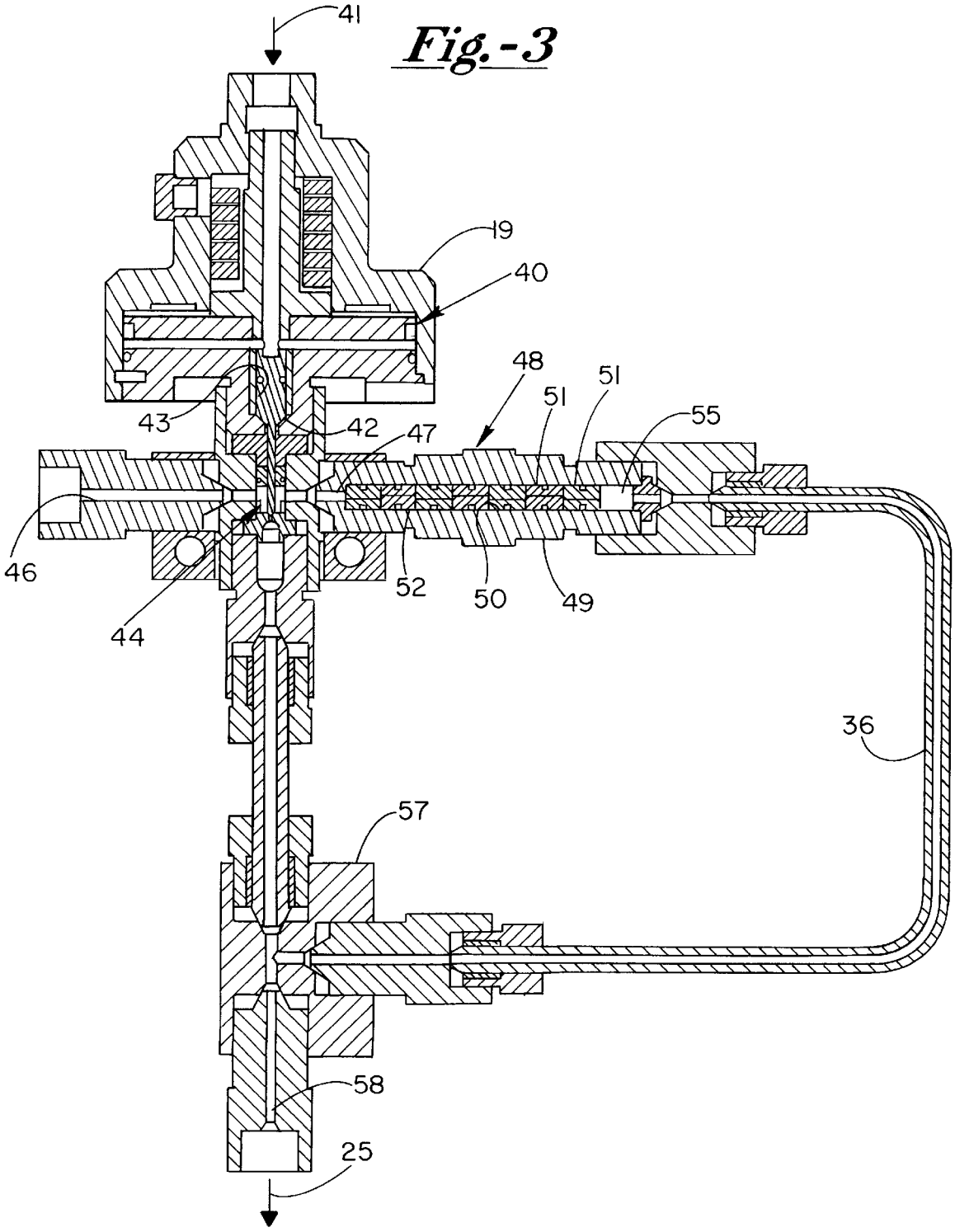

With attention now being directed to FIG. 3 of the drawings, it will be observed that valve 19 is provided with a control mechanism generally designated 40 which operates through the application of compressed air along line 41 couples directly to mechanism 40. Needle valve 42 is disposed axially within bore 43 so as to control flow through the "T" section generally designated 44. Ultra-high pressure water enters valve 19 as at a bore or orifice 46. With needle valve 42 in closed disposition (as shown) the flow of ultra-high pressure water continues through bore 47 into the pressure reducing assembly shown generally at 48.

Pressure reducing assembly 48 includes a cylindrical body member having a bore 50 formed therewithin, with bore 50 including a plurality of axially aligned serially disposed pressure reducing spools or sleeves such as at 51—51. Spools 51 are provided with eccentric bores as at 52 to permit a continuous flow of water through these eccentrically disposed channels with pressure reduced from the ultra-high pressure, water is discharged from pressure reducer 48 at 55. Flow then continues through line 36 to "T" fitting 57, and thence through discharge 58 into conduit 25.

Figure 4:
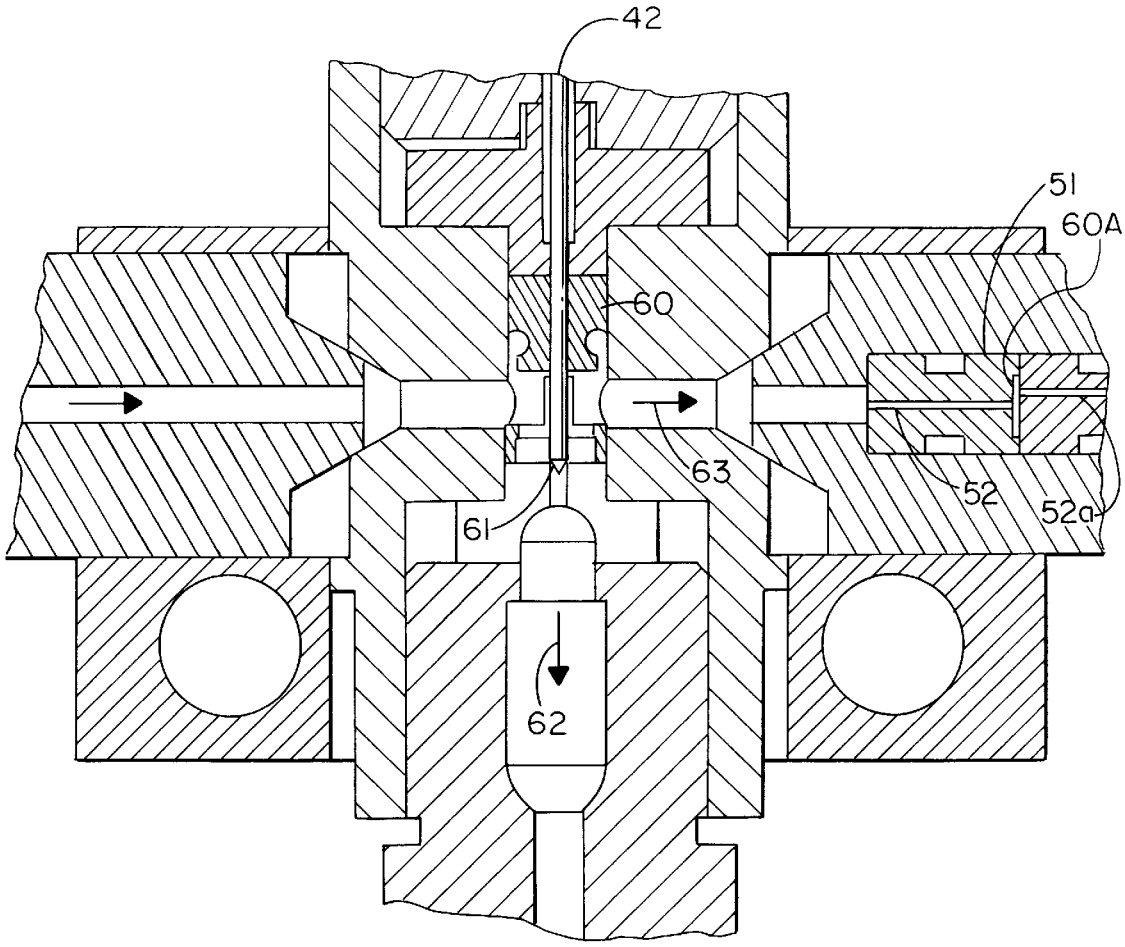

With attention now being directed to FIG. 4 of the drawings, the working stem of needle valve 42 is illustrated in its closed or seated position, with the stem portion extending through seal packing 60. Individual cylinders forming the pressure reducing spools 51 are also illustrated, with the eccentric flow channels such as at 52 having a proximal basin-like zone or opening 60A formed at one end. Basin 60A is sufficiently large in diameter so as to fully encompass next adjacent eccentric channel in the next or succeeding spool, such as shown in FIG. 4 at 52A.

With continued attention being directed to FIG. 4, it will be observed that when needle valve 42 is lifted from seat 61, ultra-high pressure water will flow along the line and in the direction of arrow 62, and onto conduit 25 for delivery to cutting head 15. In other words, when needle valve 61 is in its open disposition, the stream of ultra-high pressure water utilized to form the ultra-high working pressure stream passes along the line and in the direction of the arrow 62. When needle valve 61 is seated, there is a constant and ongoing flow of water along the line and in the direction of the arrow 63 for entry into the pressure reduction component of the system.

In a typical operational mode, the volume of ultra-high pressure water passing through the pressure reduction/bypass arm will be between about 10% and 15% of the overall volume being carried, particularly during the time that ultra-high pressure water is not being delivered through the cutting nozzle. Under operational conditions, and with ultra-high pressure water flowing only through the pressure reduction/bypass arm, the working pressure at the nozzle is normally between about 5000 and 20,000 psi, and preferably at 12,000 psi. In a specific mode, with selector valve open and when the pressure at the cutting nozzle is 20,000 psi, a typical volume rate of flow is 15% of the flow with ultra-high pressure water flowing to the nozzle.

It will be appreciated, therefore, that the present invention provides a system in which a working stream of water entrained abrasive may be delivered to a workpiece to significantly different working pressures. The system provides for the utilization of a cutting head capable of delivering a working stream at an ultra-high working pressure in excess of 55,000 to 80,000 psi while at the same time being capable of delivering a second extreme of somewhat reduced working pressure such as in the area from between 5,000 and 20,000 psi. Actuation of a single valve enables the conversion from one of the working pressures to the other. Thus, continuous operation and actuation of the pump/intensifier for the system is possible so as to enable operation of the system on a substantially continuous basis. Accordingly, it is possible to initiate edge cuts as well as piercing operations at one working pressure, while continuing and maintaining operation of the system at the desired ultra-high working pressure for higher speed cutting operations.

It would be appreciated that the features of the present invention as disclosed herein are for purposes of illustration only, and are not to be construed as a limitation upon the scope of the following appended claims.

What is claimed is:

1. In an ultra-high pressure waterjet cutting system comprising a pump means for providing a source of ultra-high pressure water, ultra-high pressure conduit means coupled to said pump for delivering a supply of said ultra-high pressure water to an input of a cutting nozzle wherein a coherent stream of ultra-high pressure water is discharged onto an object to be cut, said system further comprising;

(a) valve means interposed along said ultra-high pressure conduit means and having an inlet for receiving a flow of ultra-high pressure water, with said valve means having first and second outlet ports, with flow through said valve means to said first outlet port being controllably operated for open and closed disposition;

(b) said first outlet port being in communication with an inlet port of said cutting nozzle and arranged for controlled delivery of ultra-high pressure thereto through said ultra-high pressure conduit means, and said second outlet port being in normally open disposition with the inlet to said valve means;

(c) a pressure reduction means, said second outlet port being in communication with an inlet port of said pressure reduction means for receiving a flow of ultra-high pressure water from said valve means;

(d) an outlet for said pressure reduction means and with said pressure reduction outlet being in communication with said ultra-high pressure conduit means between said valve means and said cutting nozzle so as to form a bypass for continuous flow of water at reduced pressure from said pressure reduction means to the inlet port of said nozzle so as to define a flow channel for continuous passage of a volume of water there through and for delivery to said cutting nozzle of said volume at a pressure substantially less than that of said ultra-high pressure water supply; and (e) the arrangement being such that while flow of ultra-high pressure water from said valve means to said nozzle is controllably interrupted, flow continues through said pressure reduction means for delivery to said nozzle and discharge therefrom at said substantially reduced pressure.

* * * * *